US011560524B2

(12) United States Patent
Wang et al.

(10) Patent No.: US 11,560,524 B2
(45) Date of Patent: Jan. 24, 2023

(54) COAL POWDER PRETREATMENT METHOD AND COAL POWDER GASIFICATION METHOD

(71) Applicants: CHINA PETROLEUM & CHEMICAL CORPORATION, Beijing (CN); SINOPEC NANJING RESEARCH INSTITUTE OF CHEMICAL INDUSTRY CO., LTD., Jiangsu (CN)

(72) Inventors: Jinli Wang, Jiangsu (CN); Jin Cai, Jiangsu (CN); Yang Yu, Jiangsu (CN); Yusheng Yin, Jiangsu (CN); Haitao Li, Jiangsu (CN); Yanfang Zhu, Jiangsu (CN); Xianliang Huang, Jiangsu (CN); Huijun Wang, Jiangsu (CN); Bengang Xu, Jiangsu (CN); Jie Zhang, Jiangsu (CN); Xueqi Wu, Jiangsu (CN); Lin Wu, Jiangsu (CN)

(73) Assignees: CHINA PETROLEUM & CHEMICAL CORPORATION, Beijing (CN); SINOPEC NANJING RESEARCH INSTITUTE OF CHEMICAL INDUSTRY CO., LTD., Jiangsu (CN)

( * ) Notice: Subject to any disclaimer, the term of this patent is extended or adjusted under 35 U.S.C. 154(b) by 13 days.

(21) Appl. No.: 17/289,480

(22) PCT Filed: Oct. 28, 2019

(86) PCT No.: PCT/CN2019/113653
§ 371 (c)(1),
(2) Date: Apr. 28, 2021

(87) PCT Pub. No.: WO2020/088398
PCT Pub. Date: May 7, 2020

(65) Prior Publication Data

US 2021/0395625 A1 Dec. 23, 2021

(30) Foreign Application Priority Data

Oct. 29, 2018 (CN) ..... 201811270816.0

(51) Int. Cl.
*C10J 3/72* (2006.01)
*C10J 3/46* (2006.01)
*C10L 9/10* (2006.01)

(52) U.S. Cl.
CPC . *C10J 3/72* (2013.01); *C10J 3/46* (2013.01); *C10L 9/10* (2013.01);
(Continued)

(58) Field of Classification Search
CPC ..... C10J 2300/093; C10J 2300/0903; C10L 9/10; C10L 9/02; C10L 9/08; C10L 2200/0209
See application file for complete search history.

(56) References Cited

U.S. PATENT DOCUMENTS 3,892,586 A * 7/1975 Vladar ..... C08K 3/22 162/171
4,468,231 A 8/1984 Bartok et al.
(Continued)

FOREIGN PATENT DOCUMENTS

CN 1429763 A 7/2003
CN 101239841 A 8/2008
(Continued)

OTHER PUBLICATIONS

International Search Report with an English translation, and Written Opinion dated Jan. 10, 2020, by the China National Intellectual Property Administration (ISA/CN) as the International Searching Authority for International Application No. PCT/CN2019/113653.

*Primary Examiner* — Imran Akram
(74) *Attorney, Agent, or Firm* — Buchanan, Ingersoll & Rooney PC

(57) ABSTRACT

Disclosed are a pulverized coal preprocessing method and a pulverized coal gasifying method. The pulverized coal pre-
(Continued)

processing method comprises the following steps: (1) performing pore broadening on pulverized coal to obtain preprocessed pulverized coal; (2) loading alkali metal ions into the preprocessed pulverized coal under an ion exchange condition to obtain alkali metal loaded pulverized coal. The method further comprises loading a chrome complex into the alkali metal loaded pulverized coal obtained in described step (2). In gasification, the pulverized coal loaded with alkali metal potassium and chrome catalysts obtained by the method has the advantages of high sulphur removal rate, high carbon conversion rate, short gasifying reaction time and high methane production.

19 Claims, 1 Drawing Sheet

(52) U.S. Cl.
CPC .. *C10J 2300/0903* (2013.01); *C10J 2300/093* (2013.01); *C10J 2300/0983* (2013.01)

(56) References Cited

U.S. PATENT DOCUMENTS

| | | | |
|---|---|---|---|
| 2001/0039760 | A1 | 11/2001 | Cheng |
| 2009/0071067 | A1 | 3/2009 | Macpherson et al. |
| 2010/0168494 | A1 | 7/2010 | Rappas et al. |

FOREIGN PATENT DOCUMENTS

| | | | | | |
|---|---|---|---|---|---|
| CN | 101795761 | A | | 8/2010 | |
| CN | 102465047 | A | | 5/2012 | |
| CN | 102489336 | A | | 6/2012 | |
| CN | 102626606 | A | * | 8/2012 | ..... B01J 20/16 |
| CN | 102796585 | A | | 11/2012 | |
| CN | 103357418 | A | | 10/2013 | |
| CN | 103509603 | A | | 1/2014 | |
| CN | 104174402 | A | | 12/2014 | |
| CN | 104437563 | A | | 3/2015 | |
| CN | 105316076 | A | | 2/2016 | |
| CN | 105567330 | A | | 5/2016 | |
| CN | 106311339 | A | | 1/2017 | |
| CN | 107413329 | A | | 12/2017 | |
| CN | 107486244 | A | | 12/2017 | |
| JP | 52074586 | A | * | 6/1977 | ..... B01J 39/24 |
| KR | 101528471 | B1 | * | 6/2015 | ..... C10B 57/12 |

* cited by examiner

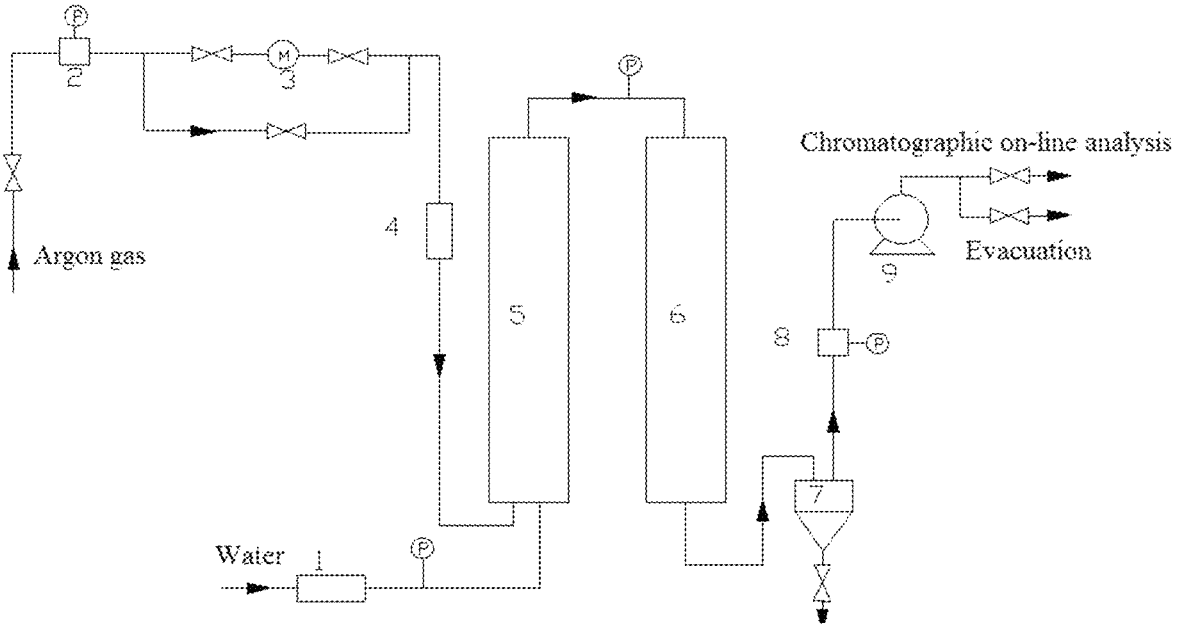
P
2
M
3
Argon gas
4
5
6
P
Chromatographic on-line analysis
Evacuation
9
8
P
7
Water
1
P

COAL POWDER PRETREATMENT METHOD AND COAL POWDER GASIFICATION METHOD

FIELD

The present disclosure relates to the technical field of coal chemical industry, and particularly to a coal powder pretreatment method and a coal powder gasification process.

BACKGROUND

The energy structural in the People's Republic of China (PRC) has the characteristics of abundant coal, deficient oil and insufficient gas resource, and China confronts with increasingly stringent requirements on environmental protection, thus the efficient and clean utilization of coal has emerged as an important task for the energy researchers in China. The coal gasification technology is one of the key technologies for the efficient and clean utilization of coal in the future, and provides an important safeguard for the sustainable energy development strategy in China. The 13th Five-year Plan for the national economic and social development of the People's Republic of China (2016-2020) issued by the National Development and Development Commission (NDRC) indicates the following content in regard to energy development: the low-carbonization process of the world energy is further accelerated, natural gas and non-fossil energy become mainstream of world energy development trend; the proportion of coal consumption will be further reduced, the share of non-fossil energy and natural gas consumption will be significantly increased, and the dual process of replacing coal with oil & gas and substituting fossil energy with non-fossil energy as the main energy resource in China will be expedited; the project of changing fuel from coal to natural gas or coal gas in key cites has been promoted with a focus on the Beijing Municipality, Tianjin Municipality, Hebei Province and surrounding areas in North China, the Yangtze River Delta region in East China, the Pearl River Delta region in South China, and the Northeast China region, the production capacity of the coal-based natural gas in China has reached about 17 billion cubic meters per year. The low-temperature catalytic gasification of coal has been a research hotspot in the technical field of coal chemical industry since the oil crisis in 1970s.

The researches on the catalysts occupy an important position in the coal catalytic gasification technologies. The technical difficulty of the coal catalytic gasification resides in the catalyst, and the researches on the catalyst focus on single component, composite component of the catalysts and disposable catalysts. At present, the alkali metal, alkaline earth metal, transition metal catalysts and the like are conventionally selected for catalytic gasification of coal, wherein the hydroxides and carbonates of alkali metals are generally recognized as the monomer catalysts with the highest efficiency. Exxon Mobil has developed the coal catalytic gasification technology in the 1970s by using salts and hydroxides of alkali metals (K, Na) or alkaline earth metals (Ca), such as $K_2CO_3$ and $Na_2CO_3$—$Ca(OH)_2$ as the catalysts. Many domestic research institutions in China have dedicated to research on coal-based natural gas, for instance, Shanxi Institute of Coal Chemistry under the Chinese Academy of Science (CAS), ENN Science and Technology Development Co., Ltd., Zhejiang University, and East China University of Science and Technology (ECUST).

CN104174402A discloses a catalyst for medium and low temperature catalytic coal gasification for producing natural gas and preparation method thereof, the method comprises the following steps: 1) weighing coal powder, impregnating the coal powder in a calcium salt solution, stirring the mixture at a temperature from the room temperature to 90° C. for 1 h-4 h, then performing suction filtration, drying in a nitrogen atmosphere at the temperature of 100° C.-200° C. for 1 h-5 h, and subsequently subjecting to cooling and grinding process to obtain a pretreated sample; 2) taking a portion of the pretreatment sample with a granularity more than 0.85 mm, impregnating the portion of pretreatment sample in a solution containing alkali metal salt and transition metal salt, stirring at a temperature from the room temperature to 90° C. for 1 h-4 h, then performing suction filtration, drying in a nitrogen atmosphere at the temperature of 100° C.-200° C. for 1 h-5 h, and subsequently subjecting to cooling and sieving process to obtain the final catalytic coal powder with the granularity of 0.25 mm-2.0 mm. The method increases the amount of produced methane in the coal powder gasification process, but still has the problems such as low conversion rate of carbon, low desulfurization rate, large fluctuation of the amount of produced methane from the coal powder deriving from different geographic sources.

CN104437563A discloses a catalytic coal gasification catalyst and a preparation method and an application thereof, wherein the method comprises the following steps: 1) taking a halide ion metal salt as a precursor of the catalyst, dissolving the halide ion metal salt in water, placing the coal-based material in the solution after the halide ion metal salt is dissolved, and fully stirring the mixture to blend the mixture uniformly, wherein the concentration of the halide ion metal salt is within a range of 0.2 mol/L-10 mol/L; 2) adjusting pH of the solution with a pH regulator, effectively dispersing the metal components on the coal-based material by virtue of an ion exchange method, performing centrifugation, washing and drying, so as to obtain the mixture of the catalyst and the coal-based material. The method avoids the corrosion of halide ions to reactor materials, has desirable gasification performance on a fixed bed reaction furnace for preparing natural gas by virtue of mild catalytic coal gasification, but the method still has the defects of low conversion rate of carbon and small amount of produced methane, the conversion rate of carbon is about 50% and the methane generation amount is about 2.0 mmol/g (C) when the gasification time is 200 min, the method also has the problems of low desulfurization rate, large variation of the amount of produced methane from the coal powder deriving from different geographic sources.

In summary, each of said prior art has the defects such as the coal powder has low desulfurization rate, low conversion rate of carbon, small amount of produced methane in the gasification process, and the gasification effect is greatly influenced by the geographic sources of coal powder. Therefore, it is urgent for those skilled in the art to solve the problems in the gasification process of coal powder, namely low desulfurization rate, low conversion rate of carbon, small amount of produced methane, and the gasification effect is greatly influenced by the geographic sources of coal powder.

SUMMARY

The present disclosure aims to overcome the defects in the prior art and provide a coal powder pretreatment method and a coal powder gasification process, both of which have the advantages of high desulfurization rate and high amount of produced methane in the gasification process of coal powder, and the gasification effect is not influenced by the geographic sources of coal powder.

In order to fulfill the above purposes, a first aspect of the present disclosure provides a coal powder pretreatment method, the method comprises the following steps:

1) subjecting the coal powder to a reaming treatment, so as to obtain a pretreated coal powder;

2) loading alkali metal ions onto the pretreated coal powder under the condition of ion exchange to obtain the alkali metal-loaded coal powder.

A second aspect of the present disclosure provides a coal powder gasification process, the process comprises pretreating coal powder by using the aforementioned method for pretreating coal powder, and gasifying the modified coal powder obtained from the pretreatment under gasification conditions.

A third aspect of the present disclosure provides a modified coal powder obtained by using the above pretreatment method.

A fourth aspect of the present disclosure provides a modified coal powder, which is powdery and comprises a coal component and an alkali metal element loaded on the coal component, wherein at least a part of the alkali metal element is chemically bonded on the coal component.

The coal powder pretreatment method in the present disclosure can significantly improve the carbon conversion rate, gasification speed, methane generation amount and desulfurization rate of the modified coal powder in the gasification process, shorten the gasification reaction time, reduce the sulfur content in the gasification reaction product, and the treatment effect is not influenced by the coal types. For example, the coal powder treated with the method of the present disclosure has the high desulfurization rate of 37.2%, the high carbon conversion rate of 93% after reaction for 150 min, and the amount of produced methane is as high as 8.35 mmol/g (C) after performing gasification for 150 min, both the carbon conversion rate and the methane generation amount substantially reach a balanced state; in the case of other conditions being identical, the method of Comparative Example 1 merely provides a desulfurization rate of 9.5%, a carbon conversion rate of 76.8% after reaction for 150 min, the amount of produced methane is only 6.4 mmol/g (C) and the coal powder requires a further gasification. The reasons for producing the favorable effects may be as follows: after the coal powder is subjected to reaming treatment, the alkali metal is loaded onto the pretreated coal powder by virtue of an ion exchange method, such that the alkali metal exchanges with H atom on functional groups —COOH and —OH in the coal powder, and the alkali metal is fixed in the coal powder in a chemical bond manner, thereby improving the carbon conversion rate, the methane generation amount and the desulfurization rate of the modified coal powder in the gasification process, shortening the gasification reaction time and reducing the sulfur content in a gasification product; in addition, because the coal powder is subjected to reaming treatment and the alkali metal is bonded in the coal powder in a chemical bond mode, the chromium complex with larger molecules loaded in a preferable mode not only can be distributed on the surface of the coal powder, but also enter porous channel of the coal powder, the initially loaded alkali metal is separated apart, so that the alkali metal and the chromium are distributed in the pore diameter of the coal powder in a cross and are highly dispersed manner, thereby further increasing the carbon conversion rate, the methane generation amount and the desulfurization rate of the modified coal powder in the gasification process, shortening the gasification reaction time and reducing the sulfur content in the gasification product.

BRIEF DESCRIPTION OF THE DRAWINGS

FIG. 1 illustrates a flow chart of a small fixed bed evaluation test.

DESCRIPTION OF THE REFERENCE SIGNS

1. water inlet device
2. front pressure reducing valve
3. mass flowmeter
4. dryer
5. vaporizer
6. fixed bed reaction furnace
7. condenser
8. back pressure valve
9. wet type flowmeter

DETAILED DESCRIPTION

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point value of the various ranges, and the individual point values may be combined with one another to produce one or more new numerical ranges, which should be deemed have been specifically disclosed herein.

A first aspect of the present disclosure provides a coal powder pretreatment method, the method comprises the following steps:

1) subjecting the coal powder to a reaming treatment, so as to obtain a pretreated coal powder;

2) loading alkali metal ions onto the pretreated coal powder under the condition of ion exchange to obtain the alkali metal-loaded coal powder.

In the present disclosure, the pores with the pore diameter of 5 nm-12 nm accounts for more than 30 vol %, preferably 35 vol %-50 vol % of the total of pores in the pretreated coal powder. In the present disclosure, the proportion of pores with the pore diameter of 5 nm-12 nm in the coal powder is measured according to a low-temperature nitrogen gas adsorption and desorption method. Generally, the proportion of pores having a pore diameter of 5 nm to 12 nm in the raw material coal powder is less than 25 vol % of the total of pores. As can be seen that the amount of pores having a pore diameter of 5 nm-12 nm is greatly increased by performing the reaming treatment.

According to a preferred embodiment of the present disclosure, the reaming treatment mode includes: contacting the coal powder with a cellulose salt solution, and then performing a heat treatment, such that the pore structure of the coal powder is improved, the moisture content in the coal powder is increased, and the ash content in the coal powder is reduced.

In the present disclosure, the conditions of contact comprise: the temperature may be within a range of 50° C.-100° C., preferably 60° C.-80° C.; and the time may be 1 h-5 h, preferably 2 h-3 h.

Preferably, the concentration of the cellulose salt solution is 0.5 wt %-5 wt %, preferably 1 wt %-3 wt %, and the weight ratio of cellulose salt solution to coal powder may be 1:(1.5-4), preferably 1:(2-3). The inventors of the present disclosure have discovered in their researches that the gasification of modified coal powder obtained by the treatment produces higher amount of methane by controlling the concentration of the cellulose salt solution within the above-described preferred range.

In the present disclosure, the coal powder is preferably contacted with the cellulose salt solution and then subjected to heat treatment under the conditions that the temperature is within a range of 120° C.-250° C., preferably 150° C.-220° C., and the time is 1 h-5 h, preferably 2 h-4 h. By virtue of the above heat treatment, the cellulose salt solution and the coal powder further interact to favorably play a role of expanding holes, and the impurities such as mineral substances in the coal powder pore channel are removed, so that the pores with the pore diameter of 5 nm-12 nm accounts for more than 30 vol % of the total of pores in the treated coal powder.

In the present disclosure, the cellulose salt is selected from the group consisting of sodium carboxymethyl cellulose, sodium carboxyethyl cellulose, calcium carboxymethyl cellulose and calcium carboxyethyl cellulose, and preferably sodium carboxymethyl cellulose. The inventors of the present disclosure have discovered that a large amount of functional groups —COOH and —OH are contained in the cellulose salt, and the coal powder pretreated with the cellulose salt solution comprises a large amount of functional groups —COOH and —OH, which provide more exchange positions for loading alkali metal onto the coal powder by virtue of an ion exchange method.

Preferably, the pretreated coal powder has a moisture content above 5 wt %, preferably above 7.5 wt %, and an ash content below 10 wt %, preferably below 5 wt %. Typically, the raw material coal powder has a moisture content less than 5 wt %, such as 3 wt %-4 wt %, and an ash content greater than 10 wt %, for example 15 wt %-20 wt %. As can be seen, by carrying out the reaming treatment in step 1), the amount of pores with the pore diameter of 5 nm-12 nm and the moisture content of the coal powder are greatly increased, the ash content of the coal powder is significantly reduced, such that the gasification rate and gasification speed of the coal powder are favorably improved.

In the present disclosure, the loading amount of the alkali metal in terms of elements is 5 parts to 12 parts by weight with respect to 100 parts by weight of the coal powder.

In the present disclosure, the mode of loading alkali metal onto the pretreated coal powder comprises: impregnating the pretreated coal powder in a solution containing an ion exchanger and alkali metal ions, then performing a solid-liquid separation, and treating the obtained solid at the temperature of 80° C.-120° C., preferably 90° C.-105° C. for 5 h-10 h, preferably 6 h-8 h.

In the present disclosure, it is preferable that the conditions of impregnating the pretreated coal powder in the mixed solution containing the ion exchanger and the alkali metal ions comprise: the temperature is within a range of 40° C.-100° C., preferably 50° C.-80° C., and the time is 1 h-6 h, preferably 2 h-5 h.

In the present disclosure, it is preferable that the mixed solution containing the ion exchanger and the alkali metal ion has a pH within a range of 8-11. The above pH can be obtained by using a pH adjuster, which is preferably used in an amount of 4 wt %-6 wt % based on the weight of the mixed solution containing the ion exchanger and the alkali metal ion. Preferably, the concentration of the ion exchanger in the solution is within a range of 8 wt %-15 wt %, preferably 10 wt %-12 wt %, and the molar ratio of ion exchanger to alkali metal ion is 1:(0.4-1.9).

In the present disclosure, the ion exchanger is used for exchanging alkali metal ions with H atoms on functional groups such as —COOH and —OH in the coal powder, any substance that can perform the function can be used as the ion exchanger of the present disclosure. Preferably, the ion exchanger is ammonium carbonate and/or ammonium bicarbonate.

In the present disclosure, it is preferable that the alkali metal ion is potassium ion from the viewpoint of facilitating recovery and improving gasification effect. The present application does not impose specific limitation to the source of potassium ion, the potassium ion is preferably provided by at least one of the group consisting of potassium carbonate, potassium formate, potassium acetate, potassium oxalate, potassium hydrogen phthalate and potassium oleate, and more preferably, the potassium ion is provided by at least one of the group consisting of potassium formate, potassium acetate, potassium oxalate, potassium hydrogen phthalate and potassium oleate containing the functional group —COOH.

The present disclosure does not impose specific limitation to the particle size of the coal powder, only if the particle size can be used in conventional gasification of coal powder, the particle size is preferably within a range of 0.15 mm-0.40 mm, and more preferably within a range of 0.18 mm-0.25 mm.

In the present disclosure, in order to avoid an introduction of other metal ion impurity, a compound in which the alkali metal ion is potassium ion may be used for adjusting the pH, for example, KOH is used as a pH adjuster. When KOH is used as the pH adjustor, the content of potassium ion in the KOH is also calculated into the aforementioned content of alkali metal.

In the present disclosure, it is preferable that the method further comprises loading a chromium complex onto the alkali metal-loaded coal powder obtained in the above step 2), so as to further increase the carbon conversion rate, the amount of methane generation amount, and the desulfurization rate of the coal powder product in the gasification process, shorten the gasification reaction time, and reduce the sulfur content in the gasification product.

In the present disclosure, the chromium complex is one or more selected from the group consisting of $Cr(NH_3)_6(OH)_3$, $Cr(H_2O)_6(OH)_3$, $Cr[(NH_3)_3(H_2O)_3](OH)_3$, $Cr[(NH_3)_5H_2O](OH)_3$, and $Cr[(NH_3)_4(H_2O)_2](OH)_3$. Because that the complex $Cr(NH_3)_6(OH)_3$ is stable, its molecular size is more suitable for being uniformly distributed in the selected pore channels of coal powder, it has stronger synergistic effect with alkali metal ions, the carbon conversion rate and the methane generation amount of the modified coal powder in the gasification process are higher, and the desulfurization effect is better. More preferably, the chromium complex is $Cr(NH_3)_6(OH)_3$.

In the present disclosure, it is preferable that the molar ratio of chromium to alkali metal in terms of metal elements may be 1:(1.5-12.5), preferably 1:(3-6.5), more preferably 1:(3.4-6.3), the chromium can separate the loaded alkali metals apart in a more effective manner, thereby further increasing the carbon conversion rate, the methane generation amount and the desulfurization rate of the modified coal powder in the gasification process, shortening the gasification reaction time and reducing the sulfur content in the gasification product.

In the present disclosure, the mode of loading the chromium complex may be an impregnation method, preferably loading the chromium complex with an equivalent-volume impregnation method. Preferably, the impregnation conditions of the chromium complex comprise: the temperature is at 30° C.-80° C., preferably 40° C.-60° C., and the time is 1 h-4 h, preferably 2 h-3 h; then the chromium complex is subjected to heating at a temperature of 80° C.-120° C., preferably 90° C.-105° C. for a time of 5 h-10 h, preferably 6 h-8 h.

In the present disclosure, the concentration of the chromium complex may be within a range of 0.5 mol/L-1.5 mol/L, preferably 0.8 mol/L-1.2 mol/L. According to a preferred embodiment of the present disclosure, the solution of the chromium complex has a pH of 7-10. The pH can be obtained by using a pH adjuster. It is preferable that the pH adjuster is used in an amount of 4 wt %-6 wt/based on the weight of the chromium complex solution.

In the present disclosure, the results of a large number of researches implemented by the inventors indicate that the coal powder is pretreated by the cellulose salt solution and then loading the pretreated coal powder with alkali metal by virtue of an ion exchange method, the method can effectively increase the carbon conversion rate, the methane generation amount and the desulfurization rate of the modified coal powder in the gasification process, shorten the gasification reaction time and reduce the sulfur content in the gasification product as compared with the prior art; the alkali metal-loaded coal powder obtained with the above method is loaded with the chromium complex in an isovolumetric manner, the method of loading the coal powder with chromium complex has the synergistic effect with the process of pretreating with cellulose salt solution and loading the alkali metal by virtue of the ion exchange method, thereby further increasing the carbon conversion rate, the methane generation amount and the desulfurization rate of the modified coal powder in the gasification process, shortening the gasification reaction time, and reducing the sulfur content in the gasification product.

A second aspect of the present disclosure provides a coal powder gasification process, the process comprises pretreating coal powder by using the aforementioned method for pretreating coal powder, and gasifying the modified coal powder obtained from the pretreatment under gasification conditions.

In the present disclosure, the method and conditions of the gasification can be performed according to the prior art, and preferably, the gasification is performed under the water vapor and the inert gas atmosphere such as nitrogen gas/argon gas, and the gasification conditions comprise: the gasification temperature is within a range of 600° C.-1,400° C., the gasification pressure is 2 MPa-6 MPa, and the gasification time is 4 h-5 h. The volume space velocity of water vapor in the gasification process is within a range of 50 $h^{-1}$-150 $h^{-1}$, the volume space velocity of nitrogen gas is 3,200 $h^{-1}$-4,800 $h^{-1}$, and an online analysis is carried out by using an Aglient7890 gas chromatograph.

When the methane generation amount and the carbon conversion rate are basically unchanged, it is determined that the gasification process is finished. The method of the present disclosure is adopted to perform pretreatment of the coal powder and load alkali metal on the pretreated coal powder, the gasification time is shortened to 2 h-3.5 h.

A third aspect of the present disclosure provides a modified coal powder obtained by using the above pretreatment method.

In the present disclosure, the particle size of the modified coal powder is preferably within a range of 0.18 mm-0.25 mm, and the modified coal powder is obtained by sieving with a sample separating sieve.

A fourth aspect of the present disclosure provides a modified coal powder, which is powdery and comprises a coal component and an alkali metal element loaded on the coal component, wherein at least a part of the alkali metal element is chemically bonded on the coal component.

According to the embodiment of the present disclosure, the amount of the alkali metal elements chemically bonded to the coal component in the modified coal powder is characterized by measuring the exchange amount of H atoms in the coal powder product, the mole number of the exchange amount of H atoms is equal to the mole number of the alkali metal elements chemically bonded to the coal component, and the mole number of the exchange amount of H atoms can be converted into the corresponding amount of the alkali metal elements chemically bonded to the coal component, preferably, the mole number of the exchange amount of H atoms is within a range of 0.65 mmol/g-3 mmol/g, preferably 1.5 mmol/g-2.5 mmol/g, and more preferably 2 mmol/g-2.5 mmol/g.

In the present disclosure, the coal component refers to a component called coal, and mainly comprises carbonaceous compounds.

In the present disclosure, in order to distinguish the coal powder prior to pretreatment and the coal powder after pretreatment, the raw material coal powder which is not pretreated may be called coal powder, and the coal powder product which is pretreated and supplied for gasification may be called modified coal powder. Preferably, the coal component is chemically bonded with 50 wt % to 100 wt %, preferably 70 wt % to 100 wt % of the alkali metal, based on the total amount of alkali metal elements in the modified coal powder. As regards whether the alkali metal element is chemically bonded to the coal component and the content of the alkali metal element in a chemically bonded form, it can be determined by means of the following method:

testing instruments: a vacuum pump, an electric heating sleeve, a pH meter, a thunder magnet, a Fourier transform infrared spectrometer, a flat-bottomed flask and a straight condensing tube;

testing reagents: 0.1 mol/L NaOH solution, 1% phenolphthalein indicator, and concentrated sulfuric acid;

testing steps: accurately weighing 0.2 g of coal sample and placing the coal sample in a 250 mL flat-bottomed flask, and adding 25 mL NaOH solution in the flat-bottomed flask, socketing a straight condensing tube with a length of about 300 mm on the upper part of the flat-bottomed flask, heating the solution in the flat-bottomed flask on an electric heating sleeve until the solution is boiled, controlling the temperature to keep a constant boiling state for 20 min, then filtering the solution, back-titrating the mixed solution consisting of the filtrate, 50 mL deionized water washing solution and 30 mL 0.1 mol/L hydrochloric acid by using 0.1 mol/L NaOH standard solution, determining the titration end point by using 3 droplets-4 droplets of phenolphthalein indicator, simultaneously performing a blank test, calculation formula: (carboxyl+phenolic hydroxyl)

$$\text{content} = \frac{c(V - V_0)}{m},$$

the unit is mmol/g;

in the formula: c refers to concentration of hydrochloric acid, the unit is mol/L, V refers to the volume of 0.1 mol/L NaOH standard solution used in titration test, the unit is L, $V_0$ refers to the volume of 0.1 mol/L NaOH standard solution used in the blank test, the unit is L, m refers to the mass of coal sample, the unit is g.

The exchange amount of H atoms in the modified coal powder is determined by using the above method, the exchange amount of H atoms is the difference of the content of the sum of the functional groups (i.e., carboxyl and phenolic hydroxyl) before and after exchange, the mole number of the exchange amount of H atoms is equal to the mole number of the alkali metal elements chemically bonded to the coal component, the mass number of the alkali metal elements bonded on the unit mass of the modified coal powder can be further calculated according to the relative atomic mass of the bonded alkali metal elements. Furthermore, the weight percentage of the mass number relative to the total amount of alkali metal elements (measured with the Inductively Coupled Plasma method (ICP)) in the modified coal powder is calculated.

In the present disclosure, it is preferable that the chemical bond refers to an ionic bond.

According to a preferred embodiment of the present disclosure, the content of the coal component is 88 wt %-95 wt %, preferably 90 wt %-92 wt %, and the content of the alkali metal element is 5 wt %-12 wt %, preferably 8 wt %-10 wt %, based on the total amount of the modified coal powder. In the present disclosure, the content of alkali metal is measured by the ICP method.

According to a preferred embodiment of the present disclosure, the modified coal powder further contains a cellulose salt. Preferably, the cellulose salt is contained in an amount of 0.5 wt %-3 wt %, preferably 1 wt %-2 wt %, the coal component is contained in an amount of 85 wt %-95 wt %, preferably 85 wt %-90 wt %, and the alkali metal element is contained in an amount of 4 wt %-15 wt %, preferably 7 wt %-15 wt %, based on the total amount of the modified coal powder. Preferably, the cellulose salt is selected from the group consisting of sodium carboxymethyl cellulose, sodium carboxyethyl cellulose, calcium carboxymethyl cellulose and calcium carboxyethyl cellulose, the cellulose salt is preferably sodium carboxymethyl cellulose. In the present disclosure, the content of the cellulose salt is obtained by measurement with the Inductively Coupled Plasma-Atomic Emission Spectrometry (ICP-AES) method and calculation (the content of the cellulose salt is obtained by measuring the content of the metal ion in the cellulose salt). The content of the coal components is calculated by subtracting the content of other components, for example, the content of the coal components=100%−the content of alkali metal element compounds−the content of cellulose salts−the content of chromium element compounds (if any).

According to a preferred embodiment of the present disclosure, the modified coal powder further comprises a complex of chromium, which is one or more selected from the group consisting of $Cr(NH_3)_6(OH)_3$, $Cr(H_2O)_6(OH)_3$, $Cr[(NH_3)_3(H_2O)_3](OH)_3$, $Cr[(NH_3)_5H_2O](OH)_3$ and $Cr[(NH_3)_4(H_2O)_2](OH)_3$, preferably $Cr(NH_3)_6(OH)_3$.

Preferably, the molar ratio of the complex of chromium relative to the alkali metal, calculated by the metal elements, is 1:(1.5-12.5), preferably 1:(3-6.5), more preferably 1:(3.4-6.3). In the present disclosure, the content of the element chromium is measured with the method stipulated in the Chinese National Standard GB/T16658-2007.

In the present disclosure, the particle size of the modified coal powder is preferably within a range of 0.18 mm-0.25 mm, and the modified coal powder is obtained by sieving with a sample separating sieve.

The present disclosure will be described in detail below with reference to examples.

In the following examples, the moisture content (wt %) is measured according to the method in the Chinese National Standard GB/T211-2007;

the ash content (wt %) is measured according to the method in the Chinese National Standard GB/T212-2008;

the determination of the content of the cellulose salt in the modified coal powder is obtained by measurement with the ICP-AES method and calculation, the specific process is as follows: the content $m_1$ of the sodium element in the modified coal powder is measured with the ICP-AES method before impregnating the modified coal powder with the cellulose salt solution, the content $m_2$ of the sodium element in the modified coal powder is measured with the ICP-AES method after the impregnation with the cellulose salt solution, the value of $m_2$-$m_1$ is exactly the content of the added sodium element in the modified coal powder, the content of the added sodium element is the content of the sodium element increased by impregnation with the cellulose salt solution, the amount of the cellulose salt loaded by impregnation can be calculated by referring to the content of the sodium element in the cellulose salt.

The proportion of the pores with the pore diameter of 5-12 nm is measured by a low-temperature nitrogen gas adsorption and desorption method, and the test instruments, equipment and materials are as follows: physical adsorption instrument (model NOVA 2200e), degasser, analytical balance, drying oven, Dewar flask, liquid nitrogen; test procedure (including test conditions): 1) sampling, obtaining a test sample according to the provision in the Chinese National Standard GB/T6678, taking a suitable amount of sample, sieving and removing dust by using a test sieve with a pore diameter Φ of 2.0 mm (meeting R40/3 series in the Chinese National Standard GB/T6003.1), placing the sieved sample in a drying oven and drying at a temperature of 105° C. for 2 h, taking out, placing in a dryer and cooling to the room temperature for later use; 2) weighing a sample tube, connecting a clean and empty sample tube to a degassing port of a degasser, vacuumizing, then filling nitrogen gas back to the normal pressure, taking the sample tube out of the degassing port, adding a rubber plug, sealing, and weighing accurately to an accuracy of 0.0001 g, wherein the mass of the sample is denoted as $M_1$; 3) filling the sample tube, weighing 0.2 g of sample (from step 1), accurately weighing to an accuracy of 0.0001 g, and placing the sample at the bottom of the sample tube by using a tool such as a forceps or a funnel, which does not pollute the sample tube; 4) switching on instruments, sequentially switching on a vacuum pump of the degasser, a main engine of the degasser, a vacuum oil pump of a physical adsorption instrument, a power supply of the main engine of the physical adsorption instrument, and starting an operation software of the physical adsorption instrument; 5) degassing a sample, comprises connecting the sample tube to a degassing port of a degasser, socketing a heating sleeve, opening a degassing switch, keeping the vacuum degree of 1.3 Pa or below, simultaneously heating to a temperature of 300° C., keeping the constant temperature for 3 hours, opening a nitrogen gas valve or an ammonia valve at the sample tube opening after the sample tube is cooled to the room temperature, refilling nitrogen gas or ammonia, removing the sample tube from the degassing port after refilling for 25 s-30 s, sealing with a rubber plug, weighting the degassed sample and denoting the weight as $M_2$; 6) desorbing a sample, injecting a suitable amount of liquid ammonia into the Dewar flask, connecting a weighed and degassed sample tube containing the sample to a physical adsorption instrument, such that the sample tube is positioned above the Dewar flask containing the liquid ammonia, and closing a prevention cover; 7) inputting control conditions on a computer control interface, respectively filling values of $M_1$ and $M_2$ into an operation interface, clicking a button "start", and subjecting to an automatic analysis by a physical adsorption instrument, thereby directly obtaining numerical values of the specific surface area, the pore volume and the average pore diameter of the sample;

the desulfurization rate of the modified coal powder is calculated and obtained by adopting the following formula:

the desulfurization rate=(sulfur content of raw coal−sulfur content of semi-coke)/sulfur content of raw coal×100% wherein, the sulfur content of raw coal and the sulfur content of semi-coke are measured according to the method in the Chinese National Standard GB/T215-2003;

the exchange amount of H atoms serves to explain the amount of alkali metal elements which are connected to the coal components through chemical bonds, and the content of functional groups (i.e., carboxyl and phenolic hydroxyl) in the coal powder which can exchange with alkali metals is measured through an ion exchange method, and the specific test process is as follows: testing instruments: a vacuum pump, an electric heating sleeve, a pH meter, a thunder magnet, a Fourier transform infrared spectrometer, a flat-bottomed flask and a straight condensing tube; test reagents: 0.1 mol/L NaOH solution, 1% phenolphthalein indicator, and concentrated sulfuric acid; test steps: accurately weighing 0.2 g of coal sample and placing the coal sample in a 250 mL flat-bottomed flask, and adding 25 mL NaOH solution in the flat-bottomed flask, socketing a straight condensing tube with a length of about 300 mm on the upper part of the flat-bottomed flask, heating the solution in the flat-bottomed flask on an electric heating sleeve until the solution is boiled, controlling the temperature to keep a constant boiling state for 20 min, then filtering the solution, back-titrating the mixed solution consisting of the filtrate, 50 mL deionized water washing solution and 30 mL 0.1 mol/L hydrochloric acid by using 0.1 mol/L NaOH standard solution, determining the titration end point by using 3 droplets-4 droplets of phenolphthalein indicator, simultaneously performing a blank test, calculation formula: (carboxyl+phenolic hydroxyl)

$$\text{content} = \frac{c(V - V_0)}{m},$$

the unit is mmol/g;

in the formula: c refers to concentration of hydrochloric acid, the unit is mol/L, V refers to the volume of 0.1 mol/L NaOH standard solution used in titration test, the unit is L, $V_0$ refers to the volume of 0.1 mol/L NaOH standard solution used in the blank test, the unit is L, m refers to the mass of coal sample, the unit is g.

the exchange amount of H atoms is the difference of the content of the sum of the functional groups (i.e., carboxyl and phenolic hydroxyl) before and after exchange, the mole number of the exchange amount of H atoms is equal to the mole number of the alkali metal elements chemically bonded to the coal component.

The content of the element potassium is measured with the ICP method;

the content of the element chromium is measured with the method stipulated in the Chinese National Standard GB/T16658-2007;

the carbon conversion rate and the methane generation amount are obtained through an online analysis performed with an Aglient7890A gas chromatograph, the analysis conditions are as follows: the temperature of a column box is 50° C., the front detector is a Flame Ionization Detector (FID) with a temperature of 250° C., the flow rate of $H_2$ is 30 mL/min, the air flow is 400 mL/min, the tail blowing flow rate is 22 mL/min, the rear detector is a Thermal Conductivity Detector (TCD) with a temperature of 250° C., the reference flow rate is 35 mL/min, and the flow rate is 2 mL/min;

wherein the carbon conversion X is defined as:

$$X = \frac{V(CO_2 + CO + CH_4) \times 12}{22.4 \times W \times C_{ad}} \times \frac{273}{273 + T} \times 100\%$$

The methane generation amount (mmol/g (C)) is defined by the following formula:

$$Y_{CH_4} = \frac{V_{CH_4}}{22.4 \times W \times C_{ad}} \times \frac{273}{273 + T}$$

Wherein:

V refers to a total output of export gas ($CO_2$, CO, $CH_4$) from the start of gasification to a certain reaction time t, the unit is L;

$V_{CH_4}$ refers to a total output of methane from the start of gasification to a certain reaction time t, the unit is L;

W refers to the mass of the coal sample used in each test, the unit is g;

$C_{ad}$ refers to the content of carbon by mass in the coal sample, the unit is %;

T refer to the ambient temperature during test, the unit is ° C.;

unless otherwise specified the solutions in the following examples refers to the aqueous solutions.

Example 1

1) a sodium carboxymethyl cellulose solution with the concentration of 2 wt % was prepared, and 50 g of Baisu coal powder (the properties of the raw material coal powder were shown in Table 1) with the particle size of 0.18 mm-0.25 mm was placed into the sodium carboxymethyl cellulose solution for impregnation (the weight ratio of the sodium carboxymethyl cellulose solution to the Baisu coal powder was 1:2), the impregnation was performed in a water bath at the temperature of 80° C. for 2 h, a filtering was conducted, a heat treatment was subsequently implemented in a drying oven at the temperature of 220° C. for 3.5 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 10.5 g potassium hydrogen phthalate was weighted, the potassium hydrogen phthalate was dissolved in 40 mL of $(NH_4)_2CO_3$ solution with the concentration of 10 wt %, and KOH was added in order to control pH of the solution to be 10, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 60° C. for 5 h, a filtering was performed after impregnation, and a treatment was implemented in the drying oven at the temperature of 100° C. for 7 h to obtain a semi-finished coal powder product;

4) 10 mL $Cr(NH_3)_6(OH)_3$ complex solution with the concentration of 1 mol/L was prepared, and KOH was added in order to control pH of the solution to be 7, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 40° C. for 3 h, a treatment was implemented in the drying oven at the temperature of 90° C. for 8 h after completion of impregnation, a sieving process is performed to prepare the modified coal powder with a particle size of 0.18 mm-0.25 mm, the modified coal powder was marked as Y—K-1.

Example 2

1) a sodium carboxymethyl cellulose solution with the concentration of 1 wt % was prepared, and 50 g of Shengli coal powder (the properties of the raw material coal powder were shown in Table 1) with the particle size of 0.18 mm-0.25 mm was placed into the sodium carboxymethyl cellulose solution for impregnation (the weight ratio of the sodium carboxymethyl cellulose solution to the Shengli coal powder was 1:2.5), the impregnation was performed in a water bath at the temperature of 60° C. for 3 h, a filtering was conducted, a heat treatment was subsequently implemented in a drying oven at the temperature of 150° C. for 4 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 4.3 g potassium formate was weighted, the potassium formate was dissolved in 40 mL of $NH_4HCO_3$ solution with the concentration of 12 wt %, and KOH was added in order to control pH of the solution to be 11, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 50° C. for 5 h, a filtering was performed after impregnation, and a treatment was implemented in the drying oven at the temperature of 95° C. for 8 h to obtain a semi-finished coal powder product;

4) 10 mL $Cr(NH_3)_6(OH)_3$ complex solution with the concentration of 1.2 mol/L was prepared, and KOH was added in order to control pH of the solution to be 9, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 60° C. for 2 h, a treatment was implemented in the drying oven at the temperature of 105° C. for 6 h after completion of impregnation, a sieving process is performed to prepare the modified coal powder with a particle size of 0.18 mm-0.25 mm, the modified coal powder was marked as Y—K-2.

Example 3

1) a sodium carboxymethyl cellulose solution with the concentration of 3 wt % was prepared, and 50 g of Shendong coal powder (the properties of the raw material coal powder were shown in Table 1) with the particle size of 0.18 mm-0.25 mm was placed into the sodium carboxymethyl cellulose solution for impregnation (the weight ratio of the sodium carboxymethyl cellulose solution to the Shendong coal powder was 1:3), the impregnation was performed in a water bath at the temperature of 70° C. for 2.5 h, a filtering was conducted, a heat treatment was subsequently implemented in a drying oven at the temperature of 190° C. for 3 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 16.4 g potassium oleate was weighted, the potassium oleate was dissolved in 40 mL of $NH_4HCO_3$ solution with the concentration of 11 wt %, and KOH was added in order to control pH of the solution to be 8, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 80° C. for 2 h, a filtering was performed after impregnation, and a treatment was implemented in the drying oven at the temperature of 105° C. for 6 h to obtain a semi-finished coal powder product;

4) 10 mL $Cr(NH_3)_6(OH)_3$ complex solution with the concentration of 0.8 mol/L was prepared, and KOH was added in order to control pH of the solution to be 10, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 50° C. for 2.5 h, a treatment was implemented in the drying oven at the temperature of 100° C. for 7 h after completion of impregnation, a sieving process is performed to prepare the modified coal powder with a particle size of 0.18 mm-0.25 mm, the modified coal powder was marked as Y—K-3.

Example 4

1) a sodium carboxymethyl cellulose solution with the concentration of 3.5 wt % was prepared, and 50 g of Baisu coal powder (the properties of the raw material coal powder were shown in Table 1) with the particle size of 0.15 mm-0.40 mm was placed into the sodium carboxymethyl cellulose solution for impregnation (the weight ratio of the sodium carboxymethyl cellulose solution to the Baisu coal powder was 1:1.5), the impregnation was performed in a water bath at the temperature of 80° C. for 2 h, a filtering was conducted, a heat treatment was subsequently implemented in a drying oven at the temperature of 220° C. for 2 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 3.5 g potassium carbonate was weighted, the potassium carbonate was dissolved in 40 mL of $(NH_4)_2CO_3$ solution with the concentration of 10 wt %, and KOH was added in order to control pH of the solution to be 11, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 60° C. for 5 h, a filtering was performed after impregnation, and a treatment was implemented in the drying oven at the temperature of 100° C. for 8 h to obtain a semi-finished coal powder product with a particle size of 0.18 mm-0.25 mm;

4) 10 mL $Cr(NH_3)_6(OH)_3$ complex solution with the concentration of 0.5 mol/L was prepared, and KOH was added in order to control pH of the solution to be 7, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 30° C. for 4 h, a treatment was implemented in the drying oven at the temperature of 80° C. for 10 h after completion of impregnation, a sieving process is performed to prepare the modified coal powder with a particle size of 0.18 mm-0.25 mm, the modified coal powder was marked as Y—K-4.

Example 5

1) a sodium carboxymethyl cellulose solution with the concentration of 0.5 wt % was prepared, and 50 g of Shengli coal powder (the properties of the raw material coal powder were shown in Table 1) with the particle size of 0.15 mm-0.40 mm was placed into the sodium carboxymethyl cellulose solution for impregnation (the weight ratio of the sodium carboxymethyl cellulose solution to the Shengli coal powder was 1:4), the impregnation was performed in a water bath at the temperature of 50° C. for 5 h, a filtering was conducted, a heat treatment was subsequently implemented in a drying oven at the temperature of 120° C. for 5 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 5 g potassium acetate was weighted, the potassium acetate was dissolved in 40 mL of $(NH_4)_2CO_3$ solution with the concentration of 12 wt %, and KOH was added in order to control pH of the solution to be 8, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 40° C. for 6 h, a filtering was performed after impregnation, and a treatment was implemented in the drying oven at the temperature of 80° C. for 10 h to obtain a semi-finished coal powder product;

4) 10 mL $Cr(NH_3)_6(OH)_3$ complex solution with the concentration of 0.7 mol/L was prepared, and KOH was added in order to control pH of the solution to be 7, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 30° C. for 4 h, a treatment was implemented in the drying oven at the temperature of 80° C. for 10 h after completion of impregnation, a sieving process is performed to prepare the modified coal powder with a particle size of 0.18 mm-0.25 mm, the modified coal powder was marked as Y—K-5.

Example 6

1) a sodium carboxymethyl cellulose solution with the concentration of 4 wt % was prepared, and 50 g of Shendong coal powder (the properties of the raw material coal powder were shown in Table 1) with the particle size of 0.15 mm-0.40 mm was placed into the sodium carboxymethyl cellulose solution for impregnation (the weight ratio of the sodium carboxymethyl cellulose solution to the Shendong coal powder was 1:3.5), the impregnation was performed in a water bath at the temperature of 90° C. for 2 h, a filtering was conducted, a heat treatment was subsequently implemented in a drying oven at the temperature of 250° C. for 1 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 10.5 g potassium hydrogen phthalate was weighted, the potassium hydrogen phthalate was dissolved in 40 mL of $NH_4HCO_3$ solution with the concentration of 10 wt %, and KOH was added in order to control pH of the solution to be 10, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 90° C. for 2 h, a filtering was performed after impregnation, and a treatment was implemented in the drying oven at the temperature of 120° C. for 5 h to obtain a semi-finished coal powder product;

4) 10 mL $Cr(NH_3)_6(OH)_3$ complex solution with the concentration of 1 mol/L was prepared, and KOH was added in order to control pH of the solution to be 9, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 80° C. for 1 h, a treatment was implemented in the drying oven at the temperature of 120° C. for 5 h after completion of impregnation, a sieving process is performed to prepare the modified coal powder with a particle size of 0.18 mm-0.25 mm, the modified coal powder was marked as Y—K-6.

Example 7

1) a sodium carboxymethyl cellulose solution with the concentration of 5 wt % was prepared, and 50 g of Shengli coal powder (the properties of the raw material coal powder were shown in Table 1) with the particle size of 0.15 mm-0.40 mm was placed into the sodium carboxymethyl cellulose solution for impregnation (the weight ratio of the sodium carboxymethyl cellulose solution to the Shengli coal powder was 1:3), the impregnation was performed in a water bath at the temperature of 100° C. for 1 h, a filtering was conducted, a heat treatment was subsequently implemented in a drying oven at the temperature of 140° C. for 3 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 9.4 g potassium oxalate was weighted, the potassium oxalate was dissolved in 40 mL of $NH_4HCO_3$ solution with the concentration of 10 wt %, and KOH was added in order to control pH of the solution to be 10, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 100° C. for 1 h, a filtering was performed after impregnation, and a treatment was implemented in the drying oven at the temperature of 110° C. for 5 h to obtain a semi-finished coal powder product;

4) 10 mL $Cr(NH_3)_6(OH)_3$ complex solution with the concentration of 1.2 mol/L was prepared, and KOH was added in order to control pH of the solution to be 10, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 70° C. for 2 h, a treatment was implemented in the drying oven at the temperature of 110° C. for 5 h after completion of impregnation, a sieving process is performed to prepare the modified coal powder with a particle size of 0.18 mm-0.25 mm, the modified coal powder was marked as Y—K-7.

Example 8

1) a sodium carboxymethyl cellulose solution with the concentration of 4.5 wt % was prepared, and 50 g of Shendong coal powder (the properties of the raw material coal powder were shown in Table 1) with the particle size of 0.15 mm-0.40 mm was placed into the sodium carboxymethyl cellulose solution for impregnation (the weight ratio of the sodium carboxymethyl cellulose solution to the Shendong coal powder was 1:2), the impregnation was performed in a water bath at the temperature of 90° C. for 2 h, a filtering was conducted, a heat treatment was subsequently implemented in a drying oven at the temperature of 220° C. for 5 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

2) 4.3 g potassium formate was weighted, the potassium formate was dissolved in 40 mL of $(NH_4)_2CO_3$ solution with the mass fraction of 10%, and KOH was added in order to control pH of the solution to be 9, so as to obtain a potassium-containing main catalyst solution dissolved with an ion exchanger;

3) 20 g pretreated coal powder with the particle size of 0.18 mm-0.25 mm was added into the solution obtained in the step 2) for impregnation, the impregnation was performed in a drying oven at the temperature of 40° C. for 6 h, a filtering was performed after impregnation, and a treatment was implemented in the drying oven at the temperature of 120° C. for 5 h to obtain a semi-finished coal powder product;

4) 10 mL $Cr(NH_3)_6(OH)_3$ complex solution with the concentration of 1.1 mol/L was prepared, and KOH was added in order to control pH of the solution to be 9, so as to obtain a chromium-containing auxiliary catalyst solution;

5) the semi-finished coal powder product obtained in step 3) was added into the chromium-containing auxiliary catalyst solution obtained in step 4) for impregnation, the impregnation was performed in a drying oven at the temperature of 70° C. for 2 h, a treatment was implemented in the drying oven at the temperature of 80° C. for 10 h after completion of impregnation, a sieving process is performed to prepare the modified coal powder with a particle size of 0.18 mm-0.25 mm, the modified coal powder was marked as Y—K-8.

Example 9

The coal powder was treated according to the same method as that of Example 3, except for that the method of Example 9 did not contain the steps 4) and 5), the moisture content, ash content and proportion of pores with a pore diameter of 5 nm-12 nm of the pretreated coal powder were illustrated in Table 1; the obtained coal powder product with the grain diameter of 0.18 mm-0.25 mm was marked as Y—K-9.

Example 10

The coal powder were treated according to the same method as that of Example 3, except that the $Cr(NH_3)_6(OH)_3$ complex in step 4) and step 5) was replaced by the equimolar chromium chloride, the moisture content, ash content and proportion of pores with a pore diameter of 5 nm-12 nm of the pretreated coal powder were illustrated in Table 1; the obtained coal powder product with the grain diameter of 0.18 mm-0.25 mm was marked as Y—K-10.

Example 11

The coal powder was treated according to the same method as that of Example 3, except that the sodium carboxymethyl cellulose solution in step 1) was replaced with HCl—HF solution, and the specific operations were as follows:

1) 50 g Shendong coal powder (the properties of the raw material coal powder were shown in Table 1) with a particle size of 0.18 mm-0.25 mm was placed in 300 mL of HCl solution (36 wt % concentrated HCl and deionized water were mixed according to a ratio of 1:1) to perform mixing and impregnation. The mixture was stirred on an automatic stirring table, subjected to standing still at room temperature for 24 h, the filtering process and washing process with deionized water were performed till there was not any $Cl^-$ ($AgNO_3$ was used for detecting whether there existed a precipitate), the deionized water was pumped, a heat treatment was performed in a vacuum oven at the temperature of 60° C. for 24 h, the coal powder washed with hydrochloric acid was subsequently mixed with concentrated HF aqueous solution having a concentration 40 wt % according to the ratio of 1 g:7.5 mL for impregnation, the mixture placed on an automatic stirring table for stirring, subjected to standing still at room temperature for 24 h, the filtering, washing and pumping process was performed, a heat treatment was performed in a vacuum oven at the temperature of 60° C. for 24 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1; the obtained modified coal powder was marked as Y—K-11.

Example 12

The coal powder was treated according to the same method as that of Example 3, except that the process of loading with potassium was performed directly without performing a heat treatment after contacting with the sodium cellulose solution. The moisture content, ash content and proportion of pores with a pore diameter of 5 nm-12 nm of the raw material coal powder and the pretreated coal powder were measured respectively, the results were illustrated in Table 1; the obtained modified coal powder was marked as Y—K-12.

Comparative Example 1

The coal powder was treated according to the same method as that of Example 3, except that the potassium oleate in step 2) and step 3) was loaded onto the pretreated coal powder in an equal volume. The moisture content, ash content and proportion of pores with a pore diameter of 5 nm-12 nm of the pretreated coal powder were illustrated in Table 1; the obtained coal powder product with the grain diameter of 0.18-0.25 mm was marked as D-K-1.

The specific operations of the step 2) and the step 3) were as follows:

16.4 g potassium oleate was weighted, the potassium oleate was dissolved in 10 mL of deionized water, 20 g pretreated coal powder with a particle size of 0.18 mm-0.25 mm was added into 10 mL of potassium oleate solution, the potassium oleate was loaded on the coal powder in an equal volume, the pretreated coal powder was added while stirring in an drying oven at the temperature of 80° C., the pretreated coal powder was mixed fully and uniformly, the stirring process was continuously performed for 1 h after the addition of coal powder was complete, the mixture was subjected to standing still for 4 h at room temperature, and a treating in the drying oven at the temperature of 105° C. for 6 h, a grinding and sieving process was performed to obtain a semi-product coal powder with a particle size of 0.18 mm-0.25 mm.

Comparative Example 2

The coal powder was treated according to the same method as that of Example 3, except that the coal powder was not subjected to treatment with sodium carboxymethyl cellulose. The obtained coal powder product with the grain diameter of 0.18 mm-0.25 mm was marked as D-K-2.

Comparative Example 3

The coal powder was treated according to the same method as that of Example 3, except that the conditions of step 1) were adjusted such that the pretreated coal powder had a proportion of pores with a pore diameter of 5 nm-12 nm less than 30%, the proportion was merely 25%, the specific operation of the step 1) was as follows:

1) a sodium carboxymethyl cellulose solution with the concentration of 0.3 wt % was prepared, and 50 g of Shendong coal powder (the properties of the raw material coal powder were shown in Table 1) with the particle size of 0.15 mm-0.40 mm was placed into the sodium carboxymethyl cellulose solution for impregnation (the weight ratio of the sodium carboxymethyl cellulose solution to the Shendong coal powder was 1:3), the impregnation was performed in a water bath at the temperature of 40° C. for 2 h, a filtering was conducted, a heat treatment was subsequently implemented in a drying oven at the temperature of 100° C. for 3 h, a sieving was performed to obtain the pretreated coal powder with a particle size of 0.18 mm-0.25 mm, the moisture content, ash content and proportion of pores with a pore diameter of 5 nm-12 nm of the raw material coal powder and the pretreated coal powder were measured respectively, the results were illustrated in Table 1;

The obtained coal powder product with the grain diameter of 0.18-0.25 mm was marked as D-K-3.

Comparative Example 4

The coal powder was treated according to the same method as that of Example 3, except that the auxiliary catalyst chromium was initially loaded and the main catalyst potassium was subsequently loaded on the coal powder. The results of the moisture content, ash content and proportion of pores with a pore diameter of 5 nm-12 nm of the pretreated coal powder were illustrated in Table 1; the obtained coal powder product with the grain diameter of 0.18 mm-0.25 mm was marked as D-K-4.

TABLE 1

| Numbers | | Test items | | |
|---|---|---|---|---|
| | | Moisture content (wt %) | Ash content (wt %) | Proportion of pores with a pore diameter of 5-12 nm (vol %) |
| Example 1 | Raw material coal powder | 3.7 | 15.1 | 23.2 |
| | Pretreated coal powder | 9.9 | 4.9 | 47.5 |
| Example 2 | Raw material coal powder | 6.5 | 14.9 | 24.1 |
| | Pretreated coal powder | 7.7 | 4.3 | 48.3 |
| Example 3 | Raw material coal powder | 3.7 | 14.2 | 20.5 |
| | Pretreated coal powder | 8.9 | 4.6 | 46.6 |
| Example 4 | Raw material coal powder | 3.7 | 15.1 | 23.2 |
| | Pretreated coal powder | 7.0 | 4.9 | 40.5 |
| Example 5 | Raw material coal powder | 6.5 | 14.9 | 24.1 |
| | Pretreated coal powder | 8.7 | 6.1 | 42.4 |
| Example 6 | Raw material coal powder | 3.7 | 14.2 | 20.5 |
| | Pretreated coal powder | 6.6 | 9.0 | 36.8 |
| Example 7 | Raw material coal powder | 6.5 | 14.9 | 24.1 |

TABLE 1-continued

| Numbers | | Test items | | |
|---|---|---|---|---|
| | | Moisture content (wt %) | Ash content (wt %) | Proportion of pores with a pore diameter of 5-12 nm (vol %) |
| | Pretreated coal powder | 8.9 | 5.4 | 39.8 |
| Example 8 | Raw material coal powder | 3.7 | 14.2 | 20.5 |
| | Pretreated coal powder | 7.5 | 8.5 | 39.8 |
| Example 9 | Pretreated coal powder | 8.9 | 4.6 | 46.6 |
| Example 10 | Pretreated coal powder | 8.9 | 4.6 | 46.6 |
| Example 11 | Pretreated coal powder | 4.4 | 10.8 | 31.5 |
| Example 12 | Pretreated coal powder | 6.9 | 5.2 | 33.2 |
| Comparative Example 1 | Pretreated coal powder | 8.9 | 4.6 | 46.6 |
| Comparative Example 3 | Pretreated coal powder | 6.6 | 11.5 | 25.0 |
| Comparative Example 4 | Pretreated coal powder | 8.9 | 4.6 | 46.6 |

TABLE 2

| Numbers | Exchange amount of H atoms (mmol/g) | Content of element potassium (wt %) | Content of element chromium (wt %) | Content of cellulose salt (wt %) |
|---|---|---|---|---|
| Y-K-1 | 2.31 | 9.8 | 2.7 | 1.9 |
| Y-K-2 | 2.18 | 9.3 | 3 | 1.3 |
| Y-K-3 | 2.25 | 9.6 | 2.3 | 2 |
| Y-K-4 | 2.02 | 8.9 | 2.7 | 2.5 |
| Y-K-5 | 1.58 | 8.8 | 2.5 | 2.9 |
| Y-K-6 | 1.71 | 10.2 | 2.6 | 0.9 |
| Y-K-7 | 1.74 | 9.8 | 3.1 | 2.4 |
| Y-K-8 | 1.69 | 9.7 | 2.2 | 0.8 |
| Y-K-9 | 2.02 | 8.9 | 0 | 2.5 |
| Y-K-10 | 2.03 | 8.9 | 2.4 | 2.5 |
| Y-K-11 | 1.32 | 8.0 | 2.5 | 0 |
| Y-K-12 | 1.28 | 7.8 | 1.8 | 2.3 |
| D-K-1 | 0.26 | 9.5 | 1.3 | 1.9 |
| D-K-2 | 0.39 | 9.4 | 2.6 | 0 |
| D-K-3 | 0.29 | 8.2 | 2.5 | 2.5 |
| D-K-4 | 0.9 | 7.9 | 2.5 | 2 |

Performance Test (1) Desulfurization Rate Test

According to the flow chart of the small fixed bed evaluation test shown in FIG. 1, the pyrolysis tests were performed in regard to the modified coal powders of Examples 1-12 and the coal powder products of Comparative Examples 1-4 on the small fixed bed test apparatus, and the specific operation steps were as follows: purging with nitrogen gas/argon gas before the test, the air in the reactor (the vaporizer 5 and the fixed bed reaction furnace 6) was placed with nitrogen gas/argon gas, nitrogen gas/argon gas was continuously introduced for boosting pressure when $O_2$ cannot be detected in the reactor, the system pressure was controlled by adjusting a back pressure valve 8, and the system airtightness was checked when the pressure was adjusted to a specified value. The pyrolysis atmosphere was a mixed gas consisting of 70% by volume of nitrogen gas/argon gas (dried by a dryer 4) and 30% by volume of water vapor (derived from a water inlet device 1), the temperature of the reactor was raised to 600° C. by a programmed temperature rise, the temperature was kept for 2 h until the sample in a bed layer was in a semi-coke state, the sample was sent into a condenser 7 for condensation, a solid product (semi-coke) was taken out from the lower part of the condenser 7, a portion of gas was analyzed by a chromatographic on-line analyzer, and the rest of gas was evacuated. The sulfur content in the raw coal and the semi-coke was measured, and the desulfurization rate was calculated, the results were shown in Table 3.

(2) Gasification Test

The modified coal powders of Examples 1-12 and the coal powder products of Comparative Examples 1-4 were respectively subjected to a gasification test in a fluidized bed test apparatus, wherein the gasification atmosphere was water vapor and nitrogen gas, the gasification temperature was 700° C., the gasification pressure was 3.5 MPa, the volume space velocity of water vapor was within a range of 50 $h^{-1}$-150 $h^{-1}$, the volume space velocity of nitrogen gas was within a range of 3,200 $h^{-1}$-4,800 $h^{-1}$, the gasification time was 200 min, and an online analysis was carried out by using an Aglient7890 gas chromatograph. The carbon conversion and methane generation amount were measured, and the results were shown in Table 3.

As can be seen from the data in the Table 3, the modified coal powder prepared with the method of the present disclosure has higher carbon conversion rate and methane generation amount, effectively shortens gasification reaction time, and increases desulfurization rate; in addition, the catalyst potassium and the catalyst chromium have synergistic effect for increasing the carbon conversion rate, the methane generation amount and the desulfurization rate and shortening the gasification reaction time.

The above content describes in detail the preferred embodiments of the present disclosure, but the present disclosure is not limited thereto. A variety of simple modifications can be made to the technical solutions of the present disclosure within the scope of the technical concept of the present disclosure, including a combination of individual technical features in any other suitable manner, such simple modifications and combinations thereof shall also be regarded as the content disclosed by the present disclosure, each of them falls into the protection scope of the present disclosure.

TABLE 3

| Test items | | Numbers | | | | | | | |
|---|---|---|---|---|---|---|---|---|---|
| | | Y-K-1 | Y-K-2 | Y-K-3 | Y-K-4 | Y-K-5 | Y-K-6 | Y-K-7 | Y-K-8 |
| Desulfurization rate (%) | | 37.2 | 35.4 | 33.2 | 30.2 | 31.5 | 29.4 | 30.2 | 28.4 |
| 50 min | Carbon conversion rate (%) | 25.1 | 24.9 | 24.6 | 22.0 | 23.2 | 23.0 | 21.9 | 22.4 |

TABLE 3-continued

| | | | | | | | | | |
|---|---|---|---|---|---|---|---|---|---|
| | Methane generation amount (mmol/g(C.)) | 2.41 | 2.38 | 2.48 | 1.90 | 2.40 | 2.17 | 2.18 | 2.25 |
| 90 min | Carbon conversion rate (%) | 55.0 | 54.5 | 54.0 | 51.5 | 53.2 | 52.1 | 50.8 | 51.7 |
| | Methane generation amount (mmol/g(C.)) | 3.85 | 3.82 | 4.0 | 3.72 | 3.82 | 3.75 | 3.8 | 3.77 |
| 120 min | Carbon conversion rate (%) | 85.5 | 85.0 | 86.5 | 83.7 | 82.2 | 82.5 | 83.0 | 81.8 |
| | Methane generation amount (mmol/g(C.)) | 8.18 | 8.22 | 8.3 | 7.9 | 7.83 | 7.85 | 7.9 | 7.95 |
| 150 min | Carbon conversion rate (%) | 92.1 | 93.0 | 92.5 | 89.8 | 88.7 | 89.5 | 91.0 | 89.0 |
| | Methane generation amount (mmol/g(C.)) | 8.25 | 8.3 | 8.35 | 8.0 | 7.9 | 7.95 | 8.05 | 8.03 |
| 200 min | Carbon conversion rate (%) | 92.5 | 93.5 | 92.8 | 91.4 | 89.8 | 90.6 | 91.3 | 90.5 |
| | Methane generation amount (mmol/g(C.)) | 8.3 | 8.28 | 8.38 | 8.05 | 7.95 | 8.0 | 8.1 | 8.1 |

| Test items | | Numbers | | | | | | | |
|---|---|---|---|---|---|---|---|---|---|
| | | Y-K-9 | Y-K-10 | Y-K-11 | Y-K-12 | D-K-1 | D-K-2 | D-K-3 | D-K-4 |
| Desulfurization rate (%) | | 11.4 | 16.5 | 25.5 | 19.9 | 9.5 | 9.2 | 7.8 | 10.5 |
| 50 min | Carbon conversion rate (%) | 24.0 | 21.5 | 20.0 | 19.2 | 17.4 | 17.1 | 19.5 | 18.3 |
| | Methane generation amount (mmol/g(C.)) | 2.38 | 1.80 | 1.75 | 1.75 | 1.55 | 1.65 | 1.77 | 1.6 |
| 90 min | Carbon conversion rate (%) | 53.6 | 48.9 | 50.5 | 48.1 | 45.5 | 45.0 | 48.5 | 46.5 |
| | Methane generation amount (mmol/g(C.)) | 3.71 | 3.60 | 3.50 | 3.52 | 2.90 | 2.82 | 3.62 | 3.25 |
| 120 min | Carbon conversion rate (%) | 83.0 | 78.8 | 79.2 | 78.2 | 71.8 | 70.5 | 74.5 | 72.3 |
| | Methane generation amount (mmol/g(C.)) | 8.11 | 6.95 | 7.20 | 7.10 | 5.3 | 5.5 | 5.5 | 5.6 |
| 150 min | Carbon conversion rate (%) | 89.1 | 84.1 | 83.5 | 82.5 | 76.8 | 75.5 | 77.0 | 77.1 |
| | Methane generation amount (mmol/g(C.)) | 8.15 | 7.45 | 7.38 | 7.25 | 6.4 | 6.6 | 6.6 | 6.7 |
| 200 min | Carbon conversion rate (%) | 90.5 | 85.5 | 87.5 | 86.5 | 83.0 | 82.4 | 84.0 | 82.9 |
| | Methane generation amount (mmol/g(C.)) | 8.20 | 7.78 | 7.55 | 7.45 | 7.1 | 6.9 | 7.3 | 7.0 |

The invention claimed is:

1. A coal powder pretreatment method, the method comprises the following steps:

1) subjecting the coal powder to a reaming treatment, so as to obtain a pretreated coal powder, wherein the reaming treatment comprises contacting the coal powder with a cellulose salt solution and then performing a heat treatment;

2) loading alkali metal ions onto the pretreated coal powder under the condition of ion exchange to obtain the alkali metal-loaded coal powder, wherein the loading alkali metal ions onto the pretreated coal powder comprises impregnating the pretreated coal powder in a solution containing an ion exchanger and alkali metal ions and then performing a solid-liquid separation.

2. The method of claim 1, wherein pores with a pore diameter of 5 nm-12 nm account for more than 30 vol % of total pores in the pretreated coal powder; the pretreated coal powder has a moisture content above 5 wt % and an ash content below 10 wt %.

3. The method of claim 1, wherein conditions of contact comprise: temperature within a range of 50° C.-100° C.; time within a range of 1 h-5 h; concentration of the cellulose salt solution within a range of 0.5 wt %-5 wt %; and weight ratio of the cellulose salt solution to coal powder within a range of 1: (1.5-4).

4. The method of claim 1, wherein the cellulose salt is one or more selected from the group consisting of sodium carboxymethyl cellulose, sodium carboxyethyl cellulose, calcium carboxymethyl cellulose and calcium carboxyethyl cellulose.

5. The method of claim 1, wherein the loading amount of the alkali metal in terms of elements is 5 parts to 12 parts by weight with respect to 100 parts by weight of the coal powder.

6. The method of claim 1, wherein the loading alkali metal ions onto the pretreated coal powder further comprises: treating the obtained solid at the temperature of 80° C.-120° C. for 5 h-10 h.

7. The method of claim 6, wherein the solution has a pH within a range of 8-11, the concentration of the ion exchanger in the solution is 8 wt % to 15 wt %, and a molar ratio of the ion exchanger to the alkali metal ion is 1: (0.4-1.9).

8. The method of claim 1, wherein the method further comprises: loading a chromium complex onto the alkali metal-loaded coal powder obtained in step 2).

9. The method of claim 8, wherein the chromium complex is one or more selected from the group consisting of $Cr(NH_3)_6(OH)_3$, $Cr(H_2O)_6(OH)_3$, $Cr[(NH_3)_3(H_2O)_3](OH)_3$, $Cr[(NH_3)_5H_2O](OH)_3$ and $Cr[(NH_3)_4(H_2O)_2](OH)_3$.

10. The method of claim 8, wherein a molar ratio of chromium to alkali metal in terms of metal elements is 1: (1.5-12.5).

11. The method of claim 8, wherein the loading the chromium complex comprises: impregnating the alkali metal-loaded coal powder obtained in step 2) with a solution of chromium complex in equivalent volume, then heating at a temperature of 80° C.-120° C. for a time of 5 h-10 h.

12. The method of claim 8, wherein conditions of impregnating the solution of the chromium complex at an equivalent volume comprise: temperature within a range of 30° C.-80° C., and time within a range of 1 h-4 h.

13. The method of claim 8, wherein the loading the chromium complex includes using a solution of the chromium complex having a pH of 7-10, and a chromium concentration within a range of 0.5 mol/L to 1.5 mol/L.

14. A coal powder gasification method, the method comprises: gasifying modified coal powder under a gasification condition, wherein the modified coal powder is powdery and comprises a coal component, a cellulose salt, and an alkali metal element loaded on the coal components, and at least a part of the alkali metal element is chemically bonded on the coal component; the modified coal powder is obtained by pretreating coal powder according to the method of claim 1.

15. The method of claim 14, wherein 50 wt %-100 wt % of the alkali metal element is chemically bonded to the coal component, based on the total amount of alkali metal element in the modified coal powder.

16. The method of claim 14, wherein the content of the coal component is 88 wt %-95 wt %, and the content of the alkali metal element is 5 wt %-12 wt %, based on the total amount of the modified coal powder.

17. The method of claim 14, wherein the cellulose salt is contained in an amount of 0.5 wt %-3 wt %, the coal component is contained in an amount of 85 wt %-95 wt %, and the alkali metal element is contained in an amount of 4 wt %-15 wt %, based on the total amount of the modified coal powder, the cellulose salt is one or more selected from the group consisting of sodium carboxymethyl cellulose, sodium carboxyethyl cellulose, calcium carboxymethyl cellulose and calcium carboxyethyl cellulose.

18. The method of claim 14, wherein the modified coal powder further comprises a complex of chromium, which is one or more selected from the group consisting of $Cr(NH_3)_6(OH)_3$, $Cr(H_2O)_6(OH)_3$, $Cr[(NH_3)_3(H_2O)_3](OH)_3$, $Cr[(NH_3)_5H_2O](OH)_3$ and $Cr[(NH_3)_4(H_2O)_2](OH)_3$.

19. The method of claim 18, wherein a molar ratio of chromium relative to alkali metal, calculated by the metal elements, is 1: (3.4-6.3).

* * * * *